US006756170B2

(12) United States Patent
Nakanishi et al.

(10) Patent No.: US 6,756,170 B2
(45) Date of Patent: Jun. 29, 2004

(54) ELECTROSTATIC IMAGE DEVELOPING TONER AND IMAGE-FORMING METHOD USING THE SAME

(75) Inventors: Yasushi Nakanishi, Tokyo (JP); Hirofumi Iemura, Tokyo (JP); Takaaki Hikosaka, Chiba (JP)

(73) Assignee: Toyo Ink Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/205,461

(22) Filed: Jul. 26, 2002

(65) Prior Publication Data

US 2003/0124446 A1 Jul. 3, 2003

(30) Foreign Application Priority Data

Dec. 28, 2001 (JP) ..... 2001-399854

(51) Int. Cl.[7] ..... G03G 9/083

(52) U.S. Cl. ..... 430/106.2; 430/108.8; 430/109.3

(58) Field of Search ..... 430/106.2, 109.3, 430/108.8

(56) References Cited

U.S. PATENT DOCUMENTS

| | | | | |
|---|---|---|---|---|
| 6,538,063 | B1 * | 3/2003 | Hikosaka et al. | 430/109.1 |
| 6,566,026 | B2 * | 5/2003 | Watanabe et al. | 430/110.1 |
| 6,582,865 | B1 * | 6/2003 | Kameoka | 430/108.1 |
| 2003/0036010 | A1 * | 2/2003 | Suzuki et al. | 430/106.1 |

FOREIGN PATENT DOCUMENTS

| | | |
|---|---|---|
| JP | 49-118729 | 11/1974 |
| JP | 49-118945 | 11/1974 |
| JP | 50-099740 | 8/1975 |
| JP | 50-099741 | 8/1975 |
| JP | 50-099742 | 8/1975 |
| JP | 52-003304 | 1/1977 |
| JP | 52-003305 | 1/1977 |
| JP | 54-034033 | 10/1979 |
| JP | 56-001952 | 1/1981 |
| JP | 56-016144 | 2/1981 |
| JP | 56-121049 | 9/1981 |
| JP | 57-052574 | 11/1982 |
| JP | 60-026950 | 2/1985 |
| JP | 60-217366 | 10/1985 |
| JP | 60-252360 | 12/1985 |
| JP | 60-252361 | 12/1985 |
| JP | 60-263951 | 12/1985 |
| JP | 61-002161 | 1/1986 |
| JP | 61-094062 | 5/1986 |
| JP | 61-138259 | 6/1986 |
| JP | 62-014166 | 1/1987 |
| JP | 62-195683 | 8/1987 |
| JP | 62-229158 | 10/1987 |
| JP | 01-109359 | 4/1989 |
| JP | 02-079860 | 3/1990 |
| JP | 02-168264 | 6/1990 |
| JP | 03-050559 | 3/1991 |
| JP | 03-294867 | 12/1991 |
| JP | 04-257868 | 9/1992 |
| JP | 05-204185 | 8/1993 |
| JP | 05-297629 | 11/1993 |
| JP | 06-075422 | 3/1994 |
| JP | 06-184249 | 7/1994 |
| JP | 08-278658 | 10/1996 |
| JP | 08-333425 | 12/1996 |
| JP | 11-052611 | 2/1999 |
| JP | 11-052612 | 2/1999 |
| JP | 11-052614 | 2/1999 |
| JP | 11-052615 | 2/1999 |
| JP | 11-052616 | 2/1999 |
| JP | 00/18840 | 4/2000 |
| JP | 2001-5214 | 1/2001 |

* cited by examiner

*Primary Examiner*—John L Goodrow
(74) *Attorney, Agent, or Firm*—McDermott, Will & Emery

(57) ABSTRACT

An electrostatic image developing toner comprising at least a binder resin and a releasant, wherein the binder resin comprises a petroleum resin and a styrene-based copolymer or styrene-based homopolymer in an amount of 5:5 to 7:3 by weight in terms of the ratio of the petroleum resin:styrene-based copolymer or styrene-based homopolymer and has the maximum molecular weight value ($P_L$) based on the petroleum resin in a range of from $5\times10^2$ to $2\times10^3$ and the maximum molecular weight value ($P_H$) based on the styrene-based copolymer or styrene-based homopolymer in a range of from $1\times10^5$ to $4.5\times10^5$ in the chromatogram obtained by measuring the binder resin through gel permeation chromatography and the releasant is a wax having a melt viscosity at 140° C. of $10^2$ mPa/s (cp) or less and is added in an amount of 1 to 7 parts by weight per 100 parts by weight of the toner.

6 Claims, No Drawings

ELECTROSTATIC IMAGE DEVELOPING TONER AND IMAGE-FORMING METHOD USING THE SAME

BACKGROUND OF THE INVENTION

1. Field of the Invention

The present invention relates to an electrostatic image developing toner to be used for developing electrostatic images in an electrophotographic copying machines, laser beam printers and electrostatic recording apparatuses wherein an image is formed utilizing an electrophotographic method or an electrostatic recording method, and a method for forming an image using the electrostatic image developing toner.

2. Description of the Related Art

In copying machines for copying an original, printers for recording output of a computer including a personal computer, or printers for facsimile receiving apparatuses, an electrophotographic method or an electrostatic recording method has long been popularly employed for obtaining a copied or recorded image. Typical examples of the copying machine or printer employing this electrophotographic method or the electrostatic recording method include an electrophotographic copying machine, a laser beam printer, a printer using a liquid crystal array and an electrostatic printer. In the electrophotographic method or the electrostatic recording method, an electrostatic latent image (electrostatic charge image) is formed on an electrostatic image carrier such as an electrophotographic photoreceptor or an electrostatic recording medium through various means, and is developed with a developer. The resultant toner image is transferred, if necessary, to a transfer medium such as paper, then fixed by heating, applying pressure, applying heat and pressure or with a solvent vapor to thereby obtain a final toner image. On the other hand, toner particles not transferred and remaining on the electrostatic image carrier are removed by a cleaning means. By repeating the above-described steps, copied products or recorded products can be obtained in sequence.

As a method for developing the electrostatic image, there have been known a method of using a liquid developer comprising a fine toner dispersed in an electrically insulating liquid; a method of using a powdery toner comprising a colorant and, if necessary, a magnetic substance dispersed in a binder resin together with a particulate carrier; and a method of conducting development using a magnetic toner comprising a magnetic substance dispersed in a binder resin and not using a particulate carrier. Of these methods, dry developing methods using a powdery toner or a magnetic toner have been mainly employed in recent years.

Incidentally, speeding up of electrophotographic copying machines and laser beam printers have recently been required with the progress of reduction in size and personalization and, in addition, it has also been required to reduce necessary energy. Therefore, with these apparatus, various improvements have been attempted to obtain a highly reliable and high-quality image at a high speed with a low energy for a long period of time through a mechanism as simple as possible. Also, in company with such improvements of the apparatus, various improvements have been attempted with respect to toners to be used for development.

For example, as an apparatus for fixing a toner image, there have been widely employed a hot-pressing fixing apparatus using a heating roller and a hot-pressing fixing apparatus wherein a roll-like or continuous heat-resistant film, so-called fixing belt, through which a heating member and the developing surface of a transfer member such as paper is faced each other, and heating is conducted by the heating member, the fixing belt and the transfer member are conveyed in this integrated state while pressing the transfer member from back side thereof using a press roller to thereby conduct hot-pressing fixation. In these methods, the heating roller or the fixing belt directly contacts with a toner image upon fixing of the toner image, and hence conduction of heat to the toner can be realized with such a good efficiency that the toner can be smoothly molten with a low energy at a high speed. In these methods, however, the molten toner comes into direct contact with the heating roller or the fixing belt. Therefore there is involved a problem of staining a transfer member such as paper due to so-called offset phenomenon. That is, a part of the molten toner on a transfer member transfers to and deposits on the surface of the heating roller or the fixing belt, and when the heating roller or the fixing belt again contacts with the transfer member, the toner having transferred and deposited on the heating roller or the like transfers again to the transfer member or, in the case where there exists no transfer member, the toner having transferred to and deposited on the heating roller or the like transfers to a pressing roll and, when a next transfer member passes through the fixing apparatus, it deposits on the back side of the transfer member.

On the other hand, in view of fixing the toner at a low temperature, it is effective to reduce a softening temperature (Tm) of a toner binder resin. However, reduction of Tm generally causes reduction of the glass transition temperature (Tg) of the toner, thus it is known that so-called toner blocking of forming a block of toner during storage or the offset phenomenon of toner upon fixing is liable to take place. This is one of the causes that inhibit to reduce the fixing temperature as one desires. As a technique for simultaneously obtaining the low-temperature fixability and blocking resistance or offset resistance, there has been proposed a technique of using a polyester-based resin which shows a comparatively low fixing temperature even when Tm or Tg is high (Japanese Unexamined Patent Publication No. 1952/1981). However, this technique fails to satisfy simultaneously and sufficiently requirements for low-temperature fixability, blocking resistance and offset resistance.

As another technique, there has been proposed to use a resin composed of a lower molecular component and a higher molecular component. For example, Japanese Unexamined Patent Publication No. 16144/1981 describes to use a styrene-based copolymer mixture showing a chromatogram obtained by gel permeation chromatography (GPC) wherein at least one maximum value of the molecular weight exist in each of a molecular weight region of from $10^3$ to $8\times10^4$ and a molecular weight region of from $10^5$ to $2\times10^6$; Japanese Unexamined Patent Publication No. 229158/1987 describes to use a polyester having 5 to 25% by weight of chloroform-insoluble component; Japanese Unexamined Patent Publication No. 168264/1990 describes to use a carboxylic acid group-containing vinyl polymer having a weight-average molecular weight of $1\times10^3$ to $2\times10^4$ and a ratio of weight-average molecular weight/number-average molecular weight of 3 or less and a carboxylic acid group-containing vinyl polymer having a weight-average molecular weight of $1.5\times10^5$ to $8\times10^5$ and a ratio of weight-average molecular weight/number-average molecular weight of 1.5 or more; Japanese Unexamined Patent Publication No. 294867/1991 describes to use a styrene-acrylic-based copolymer having a molecular weight distribution showing a gel permeation chromatogram wherein a maximum value of the molecular weight exists in each of a molecular weight region of $1\times10^5$ or more and a molecular weight region of from 500 to $2\times10^4$, and wherein a minimum value of the molecular weight exists between the two maximum values, and a ratio of the sum of the areas of two peaks respectively containing the two maximum values to the area of the valley under a tangential line common to the two peaks and containing the minimum value is 0.30 or less; and Japanese Unexamined Patent Publication No. 297629/1993 describes to use a binder resin which has a molecular weight distribution measured by GPC wherein at least one peak exists in a molecular weight region of from $3\times10^3$ to $5\times10^4$ and at least one peak in a molecular weight region of $10^5$ or more, which contains 50% or more components of $10^5$ or less in molecular weight, and which shows specific properties in a DSC curve obtained by measuring with a differential scanning calorimeter. With these binder resins, the low-molecular components are considered to contribute to the low temperature fixability, whereas the high-molecular components are considered to contribute to the blocking resistance or the offset resistance. With these known binder resins, however, there is involved a problem that, as the average molecular weight of the low-molecular component is decreased in order to obtain fixability at a lower temperature, the styrene-based resin having conventionally been widely used as binder resin becomes liquid or undergoes such a decrease in the glass transition point (Tg) that there results a poor storage stability. Thus, in actual fact, when the maximum molecular weight value of the low-molecular component becomes about 2,500 or less, such resin cannot be used as a binder resin for a toner, and hence there have been no binder resins for a toner which show a sufficient fixability at a lower temperature.

Further, in order to prevent the offset phenomenon of a toner, it has been proposed to incorporate in the toner itself a releasant that will be molten by heating upon fixation and come out of the toner to prevent the offset phenomenon. As such releasant, there have been proposed a number of waxes such as low molecular weight polyethylene, low molecular weight polypropylene, hydrocarbon-based waxes, natural waxes, and modified waxes thereof.

As to the techniques for preventing the offset phenomenon of a toner by incorporating the waxes or modified waxes in the toner and as to the waxes or modified waxes to be incorporated in the toner, various descriptions are given in, for example, Japanese Examined Patent Publication No. 3304/1977, Japanese Examined Patent Publication No. 3305/1977, Japanese Examined Patent Publication No. 52574/1982, Japanese Unexamined Patent Publication No. 217366/1985, Japanese Unexamined Patent Publication No. 252360/1985, Japanese Unexamined Patent Publication No. 252361/1985, Japanese Unexamined Patent Publication No. 138259/1986, Japanese Unexamined Patent Publication No. 94062/1986, Japanese Unexamined Patent Publication No. 14166/1987, Japanese Unexamined Patent Publication No. 195683/1987, Japanese Unexamined Patent Publication No. 109359/1989, Japanese Unexamined Patent Publication No. 79860/1990, Japanese Unexamined Patent Publication No. 50559/1991, Japanese Unexamined Patent Publication No. 204185/1993, and Japanese Unexamined Patent Publication No. 75422/1994. However, these waxes to be added to a toner for imparting releasing properties are essentially poor in compatibility with the binder resins and are difficult to uniformly disperse in a toner. In addition, in case where a large amount of the wax is added to the toner in order to prevent the offset phenomenon, the wax is unevenly distributed and, upon pulverizing the toner, the wax is liberated, and the thus liberated wax in turn causes filming on the photoreceptor, developing sleeve, carrier particles, etc., thus causing deterioration of a developed image, and problems such as reduction of fluidity of the toner and blocking of the toner.

On the other hand, an attempt has long been made to use a petroleum resin as a binder resin component of a toner for electrophotography. For example, Japanese Unexamined Patent Publication No. 121049/1981 proposes a pressure-fixable toner containing a $C_5$ to $C_6$ aliphatic petroleum resin; Japanese Unexamined Patent Publication No. 26950/1985 proposes a pressure-fixable toner containing a petroleum resin composed of $C_5$ aliphatic hydrocarbons; and Japanese Unexamined Patent Publication Nos. 263951/1985 and 2161/19861 propose a pressure-fixable toner containing a petroleum resin having a softening point of 160° C. or lower than that. These toners are proposed noting the generally soft properties of the petroleum resins. It is further known to use the petroleum resin as a part of a binder resin for a toner to be fixed according to the heat-fixing method. Examples thereof are described in, for example, Japanese Unexamined Patent Publication No. 99740/1975, Japanese Unexamined Patent Publication No. 99741/1975, Japanese Unexamined Patent Publication No. 99742/1975, Japanese Unexamined Patent Publication No. 257868/1992, Japanese Unexamined Patent Publication No. 278658/1996, Japanese Unexamined Patent Publication No. 52611/1999, Japanese Unexamined Patent Publication No. 52612/1999, Japanese Unexamined Patent Publication No. 52614/1999, Japanese Unexamined Patent Publication No. 52615/1999, Japanese Unexamined Patent Publication No. 52616/1999, and Japanese Unexamined Patent Publication No. 5214/2001. Many of the binder resins described in these publications use the petroleum resin as an auxiliary component of the toner binder resin, and there are no binder resins which sufficiently satisfy the requirements for low-temperature fixability, blocking resistance, offset resistance, and pulverizability upon production of a toner.

Thus, there have been desired an electrostatic image developing toner that permits good fixation at a lower temperature than with conventional toners, shows an excellent blocking resistance and offset resistance, and does not involve the problem with respect to pulverizability upon production of a toner. In addition, in order to save sources and reduce copying cost, there have also been demanded a toner that can provide a toner image with a sufficient density even when used in a small amount, and an image-forming method using such toner.

An object of the invention is to provide an electrostatic image developing toner capable of solving the above-described problems.

That is, an object of the invention is to provide an electrostatic image developing toner, which has an excellent low-temperature fixability and an excellent offset resistance.

Another object of the invention is to provide an electrostatic image developing toner, which has an excellent low-temperature fixability and an excellent offset resistance and which, when stored or left for a long period of time, does not suffer deterioration.

A further object of the invention is to provide an electrostatic image developing toner which has the above described various properties at the same time and has an excellent pulverizability.

A still further object of the invention is to provide a method for conducting fixation at a low temperature using an electrostatic image developing toner having the above-described properties and forming a copied or recorded image without causing offset phenomenon.

A yet further object of the invention is to provide an electrostatic image developing toner that can provide a copied or recorded product having an enough density even when it is used only in a small amount.

SUMMARY OF THE INVENTION

As a result of intensive investigations to solve the above described problems with the conventional toners, the inventors have found that a copied or recorded product with a desired density can be obtained even when a toner is used only in a small amount with an excellent low temperature fixability without causing blocking or offset phenomenon of the toner, as has conventionally been desired, by using a petroleum resin as a low molecular component of a toner binder resin and, as a high molecular component of the toner binder resin, a styrene-based copolymer or a styrene-based homopolymer, with adjusting the ranges of molecular weight where the maximum values of the molecular weight of the petroleum resin and that of the styrene-based copolymer or the styrene-based homopolymer in a chromatogram of the toner binder resin measured according to gel permeation chromatography (GPC) exist in a specific range and adjusting the ratio of the amounts thereof to specific ranges, and, further using a wax having a low melt viscosity at 140° C. as a releasant, and that such toner has an excellent pulverizability upon production of the toner, thus having achieved the present invention based on the findings.

That is, the present invention provides an electrostatic image developing toner containing at least a binder resin and a releasant, wherein the binder resin comprises a petroleum resin and a styrene-based copolymer or styrene-based homopolymer in an amount of 5:5 to 7:3 by weight in terms of the ratio of the petroleum resin:styrene-based copolymer or styrene-based homopolymer and has the maximum molecular weight value ($P_L$) based on the petroleum resin in a range of from $5\times10^2$ to $2\times10^3$ and the maximum molecular weight value ($P_H$) based on the styrene-based copolymer or styrene-based homopolymer in a range of from $1\times10^5$ to $4.5\times10^5$ in the chromatogram obtained by measuring the binder resin through gel permeation chromatography and, in addition, the releasant is a wax having a melt viscosity at 140° C. of $10^2$ mPa/s (cp) or less and is added in an amount of 1 to 7 parts by weight per 100 parts by weight of the toner.

The invention also provides an image-forming method, which involves a step of forming an electrostatic image by forming an electrostatic latent image on an electrostatic latent image carrier; an image-forming step of developing the electrostatic latent image using the above-described electrostatic image developing toner; a transferring step of transferring the toner image on a transfer member; and a step of heat-fixing by heating the toner image transferred onto the transfer member.

In the invention, it is preferred that the petroleum resin has a glass transition point Tg of 35 to 55° C., and the styrene-based copolymer has a glass transition point Tg of 50 to 75° C.

In addition, it is preferred in the invention that $H_{PL}:H_M:H_{PH}$=25 to 65:1:20 to 40, wherein $H_{PL}$ represents the height of the maximum molecular weight value $P_L$ based on the petroleum resin in the chromatogram obtained by measuring through gel permeation chromatography, $H_{PH}$ represents the height of the maximum molecular weight value $P_H$ based on the styrene-based copolymer or the styrene-based homopolymer in the chromatogram obtained by measuring through gel permeation chromatography, and $H_M$ represents the minimum height between the two maximum values.

In the invention, the wax preferably shows a weight loss of less than 1.5% when subjected to measurement in a thermal analysis apparatus TGA at 200° C.

In the invention, the low molecular component of petroleum resin mainly governs the fixability, whereas the high molecular component of styrene-based copolymer or styrene-based homopolymer mainly governs the offset-resistant properties and the anti-block properties. The fixability, offset-resistant properties and anti-block properties can be well balanced by properly mixing these components. Also, releasing properties of the toner are more improved by the releasant to obtain a fixed image without offset phenomenon.

DETAILED DESCRIPTION OF THE INVENTION

The invention is described in more detail below.

As the petroleum resin to be used in the invention as a low molecular component in the binder resin, any petroleum resin may be used that has the maximum molecular weight value ($P_L$) based on the petroleum resin in a range of from $5\times10^2$ to $2\times10^3$ in the chromatogram of binder resin obtained by measuring through gel permeation chromatography (GPC), and there are no particular limits as to the kind of petroleum resin. The maximum molecular weight value ($P_L$) based on the petroleum resin is preferably from $5\times10^2$ to $1.3\times10^3$, more preferably from $8\times10^2$ to $1.3\times10^3$. In order to obtain a petroleum resin having the maximum value ($P_L$) of the molecular weight in the above-described molecular weight range, it suffices to use a petroleum resin which shows a maximum value of the molecular weight in the range of from $5\times10^2$ to $2\times10^3$, preferably from $5\times10^2$ to $1.3\times10^3$, more preferably from $8\times10^2$ to $1.3\times10^3$, in the chromatogram obtained by measuring through GPC. Thus, a petroleum resin having the maximum molecular weight value in the above-described range may properly be selected to use among conventionally known petroleum resins such as aliphatic petroleum resins, aromatic petroleum resins, cyclopentadiene-based petroleum resins, alicyclic aliphatic petroleum resins, copolymer-based petroleum resins obtained by copolymerizing two or more of raw material monomers of these petroleum resins or by copolymerizing said raw material monomer with other polymerizable monomer, and hydrogenated products of these petroleum resins. Additionally, the hydrogenated petroleum resins are made light-colored, and hence, in the case of producing color toners, the hydrogenated petroleum resins are preferably used. Particularly, in the case of using the petroleum resin for color toners, it is preferred to use those petroleum resins which has a Gardner color number (measured according to JIS K6901) of 10 or less, more preferably 5 or less, still more preferably 2 or less.

As the aliphatic petroleum resin, there are illustrated, for example, those resins which are obtained by polymerizing at least one member selected from among polymerizable components contained in C4 to C6 fractions having a boiling point of −10 to 100° C. of the naphtha cracking oil, specifically at least one member selected from among a C4 fraction containing 1-butene, 2-butene, iso-butene and 1,3-butadiene; a C5 fraction containing 1-pentene, 2-pentene, 2-methyl-1-butene, 3-methyl-1-butene, 2-methyl-2-butene, 1,3-pentadiene, cyclopentene, cyclopentadiene, and 2-methyl-1,3-butadiene (isoprene); a C6 fraction containing 1-hexene, 2-hexene, 3-hexene, 4-methyl-1-pentene, 4-methyl-2-pentene, 2-methyl-2-pentene, 2-methyl-1-pentene, 3-methyl-2-pentene, 2-ethyl-1-butene, 2,3-dimethyl-1-butene, 2,3-dimethyl-2-butene, 2,2-dimethyl-1-butene, 1,3-hexadiene, 1,4-hexadiene, 2-methyl-1,4-pentadiene, 3-methyl-1,4-pentadiene, 1,5-hexadiene, 2,4-hexadiene, 2-methyl-1,3-pentadiene, 3-methyl-1,3-pentadiene, 4-methyl-1,3-pentadiene, cyclohexene, 1,3-cyclohexadiene, 1,4-cyclohexadiene, 1-methylcyclopentene, 3-methylcyclopentene, 4-methylcyclopentene; and monomers obtained by purifying these polymerizable components.

As the aromatic petroleum resin, there are illustrated, for example, those resins which are obtained by polymerizing at least one member selected from among aromatic vinyl monomers mainly contained in C8 to C10 fractions of the naphtha cracking oil (styrene, α-methylstyrene, vinyltoluene, isopropenyltoluene, indene, alkyl-substituted indene, allylbenzene, allyltoluene, tert-butyltoluene, tert-butylallylbenzene, etc.) and monomers obtained by purifying these components.

Also, as the cyclopentadiene-based petroleum resin and the alicyclic aliphatic petroleum resin, there are illustrated, for example, those resins which are obtained by polymerizing at least one member selected from among alicyclic unsaturated hydrocarbon monomers obtained by cyclizing and dimerizing dienes or olefins contained in a fraction having a boiling point of −10 to 50° C. of the naphtha cracking oil through Diels-Alder.

As other polymerizable monomers to be used for the copolymer-based petroleum resin, there are illustrated, for example, known monomers such as chain olefins containing 2 to 20 carbon atoms (e.g., ethylene, propylene, octene, dodecene, etc.); cyclic olefins containing 7 to 20 carbon atoms (e.g., pinene, etc.); polyenes containing 6 to 20 carbon atoms (e.g., limonene, myrcene, etc.); (meth)acrylic esters (e.g., methyl (meth)acrylate, ethyl (meth)acrylate, butyl (meth)acrylate, octyl (meth)acrylate, phenyl (meth)acrylate, stearyl (meth)acrylate, etc.); vinyl halides (e.g., vinyl chloride, vinylidene chloride, 1,2-dichloroethylene, trichloroethylene, tetrachloroethylene, vinyl fluoride, vinylidene fluoride, 1,2-difluoroethylene, trifluoroethylene, tetrafluoroethylene, vinyl bromide, etc.); vinylsilanes (e.g., trialkylvinylsilane, trialkoxyvinylsilane, etc.); α,β-unsaturated ketones (e.g., methyl vinyl ketone, phenyl vinyl ketone, etc.) and, further, acrylic acid, methacrylic acid, acrylonitrile, vinyl acetate, maleic acid, maleic ester, maleic anhydride, cyclopropane and its derivatives, cyclobutane and its derivatives, oxetane and its derivatives, tetrahydrofuran and its derivatives, acetylene and its derivatives, α,β-unsaturated aldehyde, α,β-unsaturated ester, dithiol containing 2 to 10 carbon atoms, and the like. These may be used independently or in combination of two or more.

In the invention, these petroleum resins may be used alone or in combination of two or more as long as the petroleum resin shows as a whole a maximum molecular weight value ($P_L$) in the range of from $5\times10^2$ to $2\times10^3$ in the chromatogram obtained by measuring through GPC. The content of the petroleum resin is preferably 50 to 70% by weight based on the whole weight of the resin for a toner.

On the other hand, as the styrene-based copolymer or styrene-based homopolymer to be used in the invention as a high molecular component in the binder resin, any styrene-based copolymer or styrene-based homopolymer may be used that has the maximum molecular weight value ($P_H$) based on the styrene-based copolymer or styrene-based homopolymer in a range of from $1\times10^5$ to $4.5\times10^5$ in the chromatogram of binder resin obtained by measuring the binder resin through GPC, and there are no particular limits as to the kind of the copolymer or homopolymer. In order to adjust so that the maximum value ($P_H$) exists in the above-described molecular weight range, it suffices to use a styrene-based homopolymer or a styrene-based homopolymer having the maximum molecular weight value in the range of from $1\times10^5$ to $4.5\times10^5$ in the chromatogram of binder resin obtained by GPC.

The styrene-based homopolymer to be used in the invention as the high molecular component includes homopolymers of styrene and its substituted derivative (styrene-based homopolymers), and the styrene-based copolymer includes copolymers between styrene and its substituted derivative, styrene-based copolymers between styrene or its substituted derivative and other vinyl monomer, and crosslinked products of the styrene-based homopolymers or copolymers. To describe more specifically, examples of the homopolymer of styrene or its substituted derivative includes polystyrene, poly-p-chlorostyrene, polyvinyltoluene, etc. Also, examples of the copolymers between styrene and its substituted derivative and examples of the copolymer between styrene or its substituted derivative and other vinyl monomer include styrene-p-chlorostyrene copolymer, styrene-propylene copolymer, styrene-vinyltoluene copolymer, styrene-vinylnaphthalene copolymer, styrene-(meth)acrylic copolymer,styrene-methyl α-chloromethacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-dimethylaminoethyl acrylate copolymer, styrene-diethylaminoethyl acrylate copolymer, styrene-butyl acrylate-diethylaminoethyl methacrylate copolymer, etc.

Examples of (meth)acrylic monomers to be used for the above-described styrene-(meth)acrylic-based copolymers include acrylic acid; methacrylic acid; acrylic acid esters such as methyl acrylate, ethyl acrylate, butyl acrylate, dodecyl acrylate, octyl acrylate, 2-ethylhexyl acrylate, phenyl acrylate, etc.; and methacrylic acid esters such as methyl methacrylate, ethyl methacrylate, butyl methacrylate, octyl methacrylate, etc. In addition, monomers such as acrylonitrile, methacrylonitrile, acrylamide, maleic acid, maleic acid half ester (e.g., butyl maleate, etc.) or maleic acid diester, vinyl acetate, vinyl chloride, vinyl ethers (e.g., vinyl methyl ether, vinyl ethyl ether, vinyl propyl ether, vinyl butyl ether, etc.) and vinyl ketones (e.g., vinyl methyl ketone, vinyl ethyl ketone, vinyl hexyl ketone, etc.) may be used as copolymerizable components together with the (meth)acrylic monomers described above.

The crosslinked products of the styrene-based homopolymer or styrene-based copolymer may commonly be produced by crosslinking the styrene-based homopolymer or styrene-based copolymer using a crosslinking agent. As the crosslinking agent to be used for producing the crosslinked product of the styrene-based homopolymer or styrene-based copolymer, there may be illustrated those compounds that have two or more unsaturated bonds. Specific examples thereof include aromatic divinyl compounds such as divinylbenzene, divinylnaphthalene, etc.; carboxylic acid esters having two or more unsaturated bonds such as ethylene glycol diacrylate, ethylene glycol dimethacrylate, etc.; divinyl compounds such as divinylaniline, divinyl ether, divinylsulfide, divinylsulfone, etc.; and those compounds that have three or more unsaturated bonds. These may be used alone or in combination of two or more of them. The crosslinking agent is used in an amount of 0.01% by weight to 10% by weight, preferably 0.05 to 5% by weight, based on the styrene-based homopolymer or the styrene-based copolymer.

These styrene-based copolymers, styrene-based homopolymers and the crosslinked products thereof may be used independently or in combination of two or more. In the case of using two or more polymers in combination, it suffices to select such combination so that the binder resin based on the resultant combined polymer blend has the maximum molecular weight value ($P_H$) in the range of from $1\times10^5$ to $4.5\times10^5$ in the chromatogram of the binder resin obtained by measuring through GPC. Usually, the maximum molecular weight value falls within the above-described range by using in combination two or more polymers having the maximum molecular weight value in the chromatogram of the polymer obtained by measuring through GPC between $1\times10^5$ and $4.5\times10^5$.

Of these polymers, polystyrene and styrene-(meth) acrylic-based copolymer are preferred as the styrene-based homopolymer and the styrene-based copolymer. Contribution of the high molecular component to the offset resistance and anti-blocking properties varies depending upon the kind of the styrene-based copolymer or the styrene-based homopolymer, for example, upon which is used as the high molecular component, the styrene-based copolymer or the styrene-based homopolymer, or upon the copolymerization ratio or kind of the (meth)acrylic monomer when the styrene-(meth)acrylic-based copolymer is selected as the styrene-based copolymer. Therefore, a toner with desired properties can be obtained by selecting an optimal one from among the styrene-based copolymers and the styrene-based homopolymers depending upon the degree of necessary offset properties and the degree of necessary fixing properties. Take the case of using the styrene-(meth)acrylic based copolymer for instance. In the case of attaching more importance to fixing properties than offset resistance, such selection is possible as to use ethylhexyl acrylate as the (meth)acrylic monomer and, in the case of attaching more importance to offset resistance, such selection is possible as to use methyl methacrylate.

The styrene-based copolymer or styrene-based homopolymer showing the maximum molecular weight ($P_H$) in the range of from $1\times10^5$ to $4.5\times10^5$ in the chromatogram of the binder resin obtained by measuring through GPC is used in an amount of preferably 5:5 to 7:3 by weight in terms of the ratio of petroleum resin:styrene-based copolymer or styrene-based homopolymer. In case where the amount of the petroleum resin is less than 50% by weight, contribution of the petroleum resin to fixing properties is so reduced that there results an insufficient fixability at a low temperature whereas, in case where the amount exceeds 70% by weight, welding takes place in a pulverizer upon producing toner particles, thus desired toner particles not being obtained with a good yield.

Additionally, in the invention, the binder resin comprises preferably the petroleum resin and the styrene-based copolymer or the styrene-based homopolymer but, if necessary, other resins may further be used in an amount not spoiling the effect of the invention. Examples of such resins include polyester resin, polyvinyl chloride, phenol resin, modified phenol resin, maleic resin, rosin-modified maleic resin, polyvinyl acetate, silicone resin, polyurethane resin, polyamide resin, epoxy resin, polyvinylbutyral, aliphatic or alicyclic hydrocarbon resin, and elastomers.

In the invention, the petroleum resin has a glass transition point Tg of preferably 35 to 55° C., and the styrene-based copolymer has a glass transition point Tg of preferably 50 to 75° C. In case where the glass transition point Tg of the petroleum resin is lower than 30° C., there results a poor offset resistance whereas, in case where the glass transition temperature Tg exceeds 55° C., there results a deteriorated fixability. On the other hand, in case where the glass transition point Tg of the styrene-based copolymer is lower than 50° C., there results a poor storage stability and a poor offset resistance whereas, in case where it exceeds 75° C., there results a deteriorated fixability.

Further, it is preferred in the invention that $H_{PL}:H_M:H_{PH}$= 25 to 65:1:20 to 40, wherein $H_{PL}$ represents the height of the maximum molecular weight value $P_L$ based on the petroleum resin in the chromatogram obtained by measuring through gel permeation chromatography, $H_{PH}$ represents the height of the maximum molecular weight value $P_H$ based on the styrene-based copolymer or the styrene-based homopolymer in the chromatogram obtained by measuring through GPC, and $H_M$ represents the minimum height between the two maximum values. In case where $H_{PL}$ is smaller than 25 or where $H_{PH}$ exceeds 40, good fixing properties are obtained with difficulty while, in case where $H_{PL}$ exceeds 65 or where $H_{PH}$ is smaller than 20, there might result the case where good offset resistance and good anti-blocking properties cannot be obtained. In addition, in case where the molecular weight distribution of the low molecular component of petroleum resin in the binder resin does not overlap that of the styrene-based copolymer or the styrene-based homopolymer, there sometimes results phase separation in the resultant binder resin, thus the molecular weight distributions of the two preferably overlapping each other.

The petroleum resin and the styrene-based copolymer or styrene-based homopolymer to be used in the binder resin may be produced by conventionally known processes. For example, as a process for producing aliphatic hydrocarbon-aromatic hydrocarbon copolymer petroleum resins, there is illustrated a process described in Japanese Unexamined Patent Publication No. 33425/1996 and, as a process for producing aromatic hydrocarbon homopolymer petroleum resin, there are illustrated processes described in Japanese Unexamined Patent Publication No. 118729/1974, Japanese Unexamined Patent Publication No. 118945/1974, and Japanese Examined Patent Publication No. 34033/1979. Also, as a process for producing styrene-(meth)acrylic copolymer, there is illustrated a process described in Japanese Unexamined Patent Publication No. 184249/1994.

Also, in the invention, the binder resin is produced by a proper homogenizing process, for example, by kneading the above-described petroleum resin, the styrene-based copolymer or styrene-based homopolymer and, if necessary, other resin or by dissolving and mixing them in a solvent. The resultant homogeneous composition may be prepared before or upon production of the toner. In the invention, the amount of the binder resin is preferably from 40 to 95 parts by weight per 100 parts by weight of the toner.

In addition, it is necessary in the invention to use a wax of $10^2$ mPa/s (cp) or less in melt viscosity at 140° C. as a releasant. Since the binder resin in the toner of the invention contains as a major component a petroleum resin having the maximum molecular weight value ($P_L$) based on the petroleum resin in the chromatogram of the binder resin obtained by measuring through GPC in the molecular weight range of from $5\times10^2$ to $2\times10^3$, the toner is softer than those toners wherein a conventional styrene-based resin is used as a major component of the binder resin. Therefore, a typical wax having conventionally been used as a releasant, Viscol 550P (whose melt viscosity at 140° C. cannot be measured because it is not molten at 140° C.), is difficult to exhibit its releasing properties. However, a toner with good releasing properties can be obtained by using a wax having a melt viscosity at 140° C. enough lower than that of conventionally used waxes, i.e., a melt viscosity at 140° C. of $10^2$ mPa/s(cp) or less. The melt viscosity at 140° C. of the wax is more preferably 70 mPa/s(cp) or less, still more preferably 50 mPa/s(cp) or less. The wax is used in an amount of 1 to 7 parts by weight, preferably 1.5 to 5 parts by weight, per 100 parts by weight of the toner. In case where the amount of the wax is less than 1 part by weight per 100 parts by weight of the toner, it becomes difficult for the wax to exhibit its releasing function.

Further, in case where the amount of the wax exceeds 7 parts by weight, there often arises a problem with compatibility with the binder resin since it is difficult to uniformly disperse the wax in the toner. That is, the wax is unevenly distributed in the toner and, upon finely pulverizing the toner, the wax is liberated, and the liberated wax in turn causes the problem of filming on a photoreceptor, a developing sleeve and a carrier, thus developed images being deteriorated. In addition, there strongly arise unfavorable results such as a decrease in toner fluidity and blocking trouble of the toner during its storage. Thus, there is involved the problem that good toner images or copied products cannot be obtained. Additionally, the melt viscosity value at 140° C. of the wax is that obtained by measuring according to the Brookfield method using a model B viscometer wherein the test sample is heated from ordinary temperature to 140° C. which is higher than the melting temperature of the sample and at which the viscosity is measured.

As the wax to be used in the invention any wax may be used that has a melt viscosity at 140° C. of $10^2$ mPa/s(cp) or lower. Such waxes may properly be selected from among those that have conventionally been known as waxes. Examples of the waxes possibly having such properties include animal or plant waxes, carnauba wax, candelilla wax, Japan wax, bees wax, mineral wax, petroleum wax, paraffin wax, microcrystalline wax, petrolatum, polyethylene wax, oxidized polyethylene wax, higher fatty acid wax, higher fatty acid ester wax and Sazol wax (Fischer-Tropsh wax). Of these, Sazol wax and microcrystalline wax are preferred. These waxes may be used independently or in combination of two or more of them. As a wax to be used in combination, polyethylene wax is preferred in the invention in view of preventing the offset phenomenon.

In addition, as the wax to be used in the invention, a wax undergoing a weight loss of less than 1.5% when measured by means of a thermal analyzer, TGA, at 200° C. is preferred. Fixation of a toner is commonly conducted at a temperature lower than 200° C., but a lower molecular component of the wax to be used as a releasant for a toner in some cases vaporizes or volatilizes upon heating for fixation to generate an offensive smell sine the wax to be used as a releasant for toner is a wax having a low-melting point. This problem of offensive smell is particularly often arises with synthetic waxes. Waxes undergoing a weight loss of less than 1.5% at 200° C. measured in the thermal analyzer TGA are preferred since they can minimize generation of the offensive smell caused by evaporation or volatilization of the low molecular component.

The electrostatic image developing toner of the invention may be a magnetic toner to be used as a single-component magnetic developer or may be a magnetic or non-magnetic toner to be used together with carrier particles. In addition, it may be positively chargeable or negatively chargeable.

The electrostatic image developing toner of the invention may contain various components having conventionally been used in producing electrostatic image developing toners, such as a colorant, a charge control agent and, with a magnetic toner, a magnetic powder in addition to the above-described binder resin and the releasant. Also, there may be added additives other than these components such as an antioxidant, a fluidizing agent, a lubricant, a conductivity-imparting agent, an abrasive, an aging inhibitor, an inhibitor against deterioration with ozone, a UV ray absorbent, a light stabilizer, a softening agent, a reinforcing agent, a filler, a mastication accelerator, a foaming agent, a foaming aid, a releasant excluding waxes having a melt viscosity at 140° C. of $10^2$ mPa/s(cp) or less, a fire retardant, an antistatic agent for incorporation, a coupling agent, an antiseptic, an aromatizing agent, etc. within amounts not spoiling the effects of the invention.

As the above-described colorant, any of dyes and pigments having conventionally been used as colorants for toners may be used. Examples of the known dyes and pigments include dyes or pigments, such as carbon black, activated carbon, copper oxide, manganese dioxide, non-magnetic ferrite, iron black, titanium white, zinc flower, Aniline Black, Aniline Blue (C.I. No. 50405), Chalconyl Blue (C.I. No. Azess Blue 3), Chrome Yellow (C.I. No. 14090), Ultramarine Blue (C.I. No. 77103), Methylene Blue Chloride (C.I. No. 52015), Phthalocyanine Blue (C.I. No. 74160), Du Pont Oil Red (C.I. No. 26015), Quinoline Yellow (C.I. No. 47005), Marachite Green Oxalate (C.I. No. 42000), lamp black (C.I. No. 77266), Rose Bengale (C.I. No. 45435), etc., and mixtures thereof. With non-magnetic toners, these colorants are used in an amount of usually 0.5 to 15 parts by weight, preferably 1 to 12 parts by weight, per 100 parts by weight of the toner. Additionally, with magnetic toners, in case where a magnetic powder also functions as a colorant, other colorant may be used as needed. As such colorants, there are illustrated, for example, carbon black, copper-phthalocyanine, iron black, etc.

As the above-described charge control agent, any of those that have conventionally been known as charge control agents for an electrostatic image developing toner may be used. As the charge control agent, a positive charge control agent or a negative charge control agent is selected depending upon polarity of the electrostatic image to be developed on an electrostatic image carrier. Examples of the positive charge control agent include Nigrosine dyes, a metal derivative of fatty acid, a triphenylmethane dye, a quaternary ammonium salt (e.g., tributylbenzylammonium 1-hydroxy-4-naphthosulfonate, tetrabutylbenzylammonium tetrafluoroborate, etc.), a diorganotin oxide (e.g., dibutyltin oxide, dioctyltin oxide, dicyclohexyltin oxide, etc.), a diorganotin borate (e.g., dibutyltin borate, dioctyltin borate, dicyclohexyltin borate, etc.), etc. These may be used alone or in combination of two or more of them. Of these, Nigrosine type agents and quaternary ammonium salts are preferred. On the other hand, examples of the negative charge control agent include carboxyl group-containing compounds such as metal salts or metal chelate (complex) of salicylic acid or its derivative, metal complex salt dyes, fatty acid soaps, metal naphthenates etc. These charge control agents are used in the binder resin in an amount of usually 0.1 to 10 parts by weight, preferably 0.5 to 8 parts by weight, per 100 parts by weight of the binder resin.

As the magnetic powder, there may be used powders of ferromagnetic metals such as iron, cobalt or nickel; powders of alloys between the ferromagnetic metal and a metal such as aluminum, cobalt, copper, lead, magnesium, tin, zinc, antimony, beryllium, bismuth, cadmium, calcium, manganese, selenium, titanium, tungsten or vanadium; iron oxides such as γ-iron oxide, magnetite and ferrite; and compounds containing iron, cobalt or nickel. As the magnetic fine particles, those that the magnetic fine particles have a BET specific surface area of 2 to 20 $m^2/g$, particularly 2.5 to 12 $m^2/g$, and a Mohs' hardness of 5 to 7 are preferred. Also, they have a particle size of commonly 100 to 800 mμ, preferably 300 to 500 mμ, and are contained in an amount of 10 to 70 parts by weight, preferably 15 to 55 parts by weight, per 100 parts by weight of the toner.

Of these magnetic powders, magnetite having a horizontal FERE diameter of 0.1 to 0.5 μm and containing 18 to 28% by weight of FeO is particularly preferred. In view of magnetic density on a development carrier, this magnetite is used in an amount of preferably 35 to 55 parts by weight per 100 parts by weight of the toner. In case where the horizontal FERE diameter of the magnetite is less than 0.1 μm, there result such a strong agglomerating force of the magnetic material that dispersibility of the magnetic material becomes poor, leading to a poor stability of charging. On the other hand, in case where the diameter exceeds 0.5 μm, the oil absorption of the magnetic material is decreased so much that the magnetic material is wrapped by the binder resin of the toner, leading to a too high insulating resistance which is liable to cause fogging at a low temperature and low humidity. In case where the content of FeO is less than 18% by weight, it becomes difficult to control magnetic properties whereas, in case where the content exceeds 28% by weight, the magnetic powder becomes so brownish that it becomes difficult to obtain a toner with a desired black color. Additionally, the term "horizontal FERE diameter" as used herein means a particle size of a magnetic material determined by a transmission electron microscope, i.e., by enlarging a X10000 photograph of a magnetic material obtained by means of the transmission electron microscope with a magnification of 4 times to prepare a X40000 photograph, selecting 250 magnetic particles at random, measuring diameters of individual particles, and determining an average diameter thereof.

Further, as the antioxidant, hindered phenol type antioxidants, aromatic amine type antioxidants, hindered amine type antioxidants, sulfide type antioxidants, organophosphorus type antioxidants, etc. can be used, with the hindered phenol type antioxidants being particularly preferred. The antioxidants may be used alone or in combination of two or more of them.

As the releasant other than the waxes having a melt viscosity at 140° C. of $10^2$ mPa/s(cp) or less, thereare illustrated, for example, waxes such as polypropylene wax, oxidized polypropylene wax, higher fatty acid wax, higher fatty acid ester wax, etc.; wax-like resins such as styrene oligomer, amorphous poly-α-olefin, etc.; etc. These releasants may be used alone or in combination of two or more of them.

As to a process for preparing the electrostatic image developing toner of the invention, there are no limitations, and the toner may properly be prepared in a conventionally known manner. To show one preferred example of the process for preparing the toner, there is illustrated a process of pre-mixing the above-described toner constituents in a dry blender, a Henschel mixer or a ball mill, melt-kneading the pre-mixed mixture in a heat kneader such as a heat roll kneader, a mono-axial or bi-axial extruder or the like, cooling the resultant kneaded product, coarsely crushing it, finely pulverizing the crushed product with a jet pulverizer etc, then classifying, if necessary, the pulverized product to obtain a toner with a desired particle size. However, processes for producing the toner of the invention are not limited only to this knead-pulverizing process, but may be any of conventionally known processes such as a process of dispersing the toner constituents in a binder resin solution and spray-drying the dispersion, a process of mixing predetermined materials in a monomer for constituting the binder resin to prepare an emulsion suspension, and conducting polymerization, and the like.

The toner to be used in the invention has an average particle size of preferably 3 to 35 μm, more preferably 4 to 20 μm. With small-sized toners, the average particle size is about 4 to about 10 μm. In the case where the developer of the invention is an insulating magnetic toner, it has an electric resistance of $10^{10}$ Ω·cm or more, preferably $10^{13}$ Ω·cm or more. The thus prepared electrostatic image developing toner is mixed with an external additive as required. Additionally, in the invention, the wax having a melt viscosity at 140° C. of $10^2$ mPa/s(cp) or less to be used as a releasant does not have such a good compatibility with the binder resin, and hence, when the binder resin and the toner constituents such as a colorant and a magnetic powder are mixed in the kneading step, liberation of the wax occurs in some cases. Therefore, it is preferred to previously well knead or melt-mix the binder resin and the wax to prepare a wax-containing resin, followed by melt-kneading it with other toner constituents.

Examples of the external additive include a lubricant, a fluidizing agent, an abrasive, etc. Specifically, examples of the lubricant include polytetrafluoroethylene, zinc stearate, etc., examples of the fluidizing agent include fine dust of polymethyl methacrylate, polystyrene, silicone, silica having or not having been subjected to a hydrophilicity-imparting treatment, alumina, titania, magnesia, amorphous silicon-aluminum co-oxide, amorphous silicon-titanium co-oxide, etc., and examples of the abrasive include fine dust of strontium titanate, calcium titanate, calcium carbonate, chromium oxide, silicon carbide, tungsten carbide, etc. In addition, such metal oxides as tin oxide may be added as electroconductivity-imparting agents. However, these are only part of the external additives, and are not intended to limit the external additive of the electrostatic image developing toner of the invention. As to the amounts of these external additives of the lubricant, the fluidizing agent and the abrasive, the lubricant is used in an amount of preferably 0.1 to 2 parts by weight per 100 parts by weight of the toner, the fluidizing agent in an amount of preferably 0.05 to 1 part by weight, and the abrasive in an amount of preferably 0.2 to 5 parts by weight. Since these external additives often exhibit charge-controlling action on the toner, it suffices to select and use a proper one depending upon intended charge properties of the toner.

The thus prepared electrostatic image developing toner is used as a two-component type developer for dry-process development by mixing with a carrier, or may be used independently as a single-component magnetic developer. As the carrier, any of those carriers may be used which have conventionally been used in two-component type dry developers.

As such carrier, there are illustrated, for example, magnetic powder carriers constituted by a magnetic powder such as a powder of ferromagnetic metal, e.g., iron or ferromagnetic metal alloy, and a ferrite powder or a magnetite powder constituted by metal oxide such as iron oxide and elements such as nickel, copper, zinc, magnesium, barium, etc.; resin-coated magnetic carriers obtained by coating these magnetic powders with a resin such as styrene-methacrylate copolymer, styrene polymer or a silicone resin; binder carriers composed of the magnetic powder and a binder resin; glass beads coated or not coated with a resin; and the like. These carriers to be used have a particle size of usually 15 to 500 μm, preferably 20 to 300 μm.

Additionally, as the coating resin for use in the resin-coated magnetic powder carrier, there may be used, for example, polyethylene, silicone resin, fluorine-containing resin, styrenic resin, acrylic resin, styrene-acrylic resin, polyvinyl acetate, cellulose derivative, maleic acid resin, epoxy resin, polyvinyl chloride, polyvinylidene chloride, polyvinyl bromide, polyvinylidene bromide, polycarbonate, polyester, polypropylene, phenol resin, polyvinyl alcohol, fumaric acid ester resin, polyacrylonitrile, polyvinyl ether, chloroprene rubber, acetal resin, ketone resin, xylene resin, butadiene rubber, styrene-butadiene copolymer, polyurethane, etc. In the resin-coated magnetic powder carrier may contain, if necessary, electroconductive fine particles (e.g., carbon black, conductive metal oxide, metal powder, etc.), an inorganic filler (e.g., silica, silicon nitride, boron nitride, alumina, zirconia, silicon carbide, boron carbide, titanium oxide, clay, talc, glass fibers, etc.), and the above-illustrated charge control agent. Thickness of the resin covering the carrier core is preferably from about 0.1 to about 5 μm.

An image-forming method of the invention is described by reference to the electrophotographic method (Carlson method). First, a photoreceptor is charged, and patternwise exposed to form an electrostatic image (electrostatic latent image). As the photoreceptor, known or well-known photoreceptors such as OPC (Organic Photo Conductor), a selenium-based photoreceptor, an amorphous silicone photoreceptor, etc. may be used. Charging may be conducted by any of a corona charging method, a contact charging method, etc. Further, patternwise exposure may also be any of known or well-known methods such as a method of scan-exposing an original using an exposure lamp, a method of exposing with a laser beam, a method of utilizing difference between transmission and non-transmission of light through pixels in a liquid crystal array, etc. Subsequently, the thus formed electrostatic latent image is developed with the developer using the electrostatic image developing toner of the present invention to thereby form a toner image on the photoreceptor. As the developing method, there may be used any of known or well-known methods such as a two-component magnetic brush method using a carrier, a single-component magnetic brush method using a magnetic toner, a micro-toning method, a jumping method using a magnetic toner or a non-magnetic toner, a cascade method, a powder cloud method, etc. After the development, the toner image on the photoreceptor is transferred to a transfer member. As the transfer member, there are illustrated paper and OHP films of polyester. The toner image transferred to the transfer member is then fixed by any of the fixing methods such as a hot-press-fixing method using a heating roller or a fixing belt, a heat-fixing method (SURF fixing, fixing with a hot plate, fixing in an oven, fixing using an IR lamp, or the like), a pressure-fixing method, a flash-fixing method, a solvent-fixing method, etc. to thereby form a fixed image on the transfer member. As the fixing method, the hot-press-fixing method using a heating roll or a fixing belt is preferred. On the other hand, the photoreceptor from which the toner image is transferred is cleaned by a known or well-known method such as using a cleaning blade to remove the toner remaining on the photoreceptor and, if necessary, subjected to charge-removing treatment, then again subjected to the charging step.

Although the image-forming method of the invention is described by reference to the Carlson process, other known or well-known electrophotographic methods may be employed as long as development is conducted by using the electrostatic image developing toner of the invention. In addition, as the electrostatic image-forming method, the conventionally known electrostatic recording method may also be employed.

The electrostatic image developing toner of the invention enables to obtain a good toner image with a good fixability at a low temperature without causing offset phenomenon. In addition, it enables to obtain a fixed image with a high smoothness and a high reflection density. That is, the toner of the invention can form an image with a high reflection density even when deposited in a small amount, thus being useful as a low-consumption type developer permitting to reduce the consumption thereof.

Additionally, in the invention, the molecular weight distribution of the binder resin or the like is measured by GPC under the following conditions.

(GPC Measuring Conditions)

Apparatus: 800 Series made by Nihon Bunko K.K.
Detector: RI
Column: Toso [MN, GMH6 (7.5 mm I.D×600 mm)×2, G2000H8(7.5 mm I.D×600 mm)]
Temperature: Room temperature
Solvent: THF
Injection amount: 400 microliters
Flow amount: 1.4 milliliters
Others: dissolved in THF at room temperature; concentration: adjusted to 20 mg/10 milliliters The invention is now described specifically by reference to Examples which, however, are not to be construed as limiting the invention in any way.

PRODUCTION EXAMPLE 1

Synthesis of Resin A and Production of Resin Composition B 200 parts by weight of a fraction having an initial boiling point of 140° C. and a final boiling point of 220° C. obtained as a by-product by steam cracking of naphtha (polymerizable components: styrene, methylstyrene, vinyltoluene, isopropenyltoluene, indene, etc.) was charged in a flask equipped with a thermometer and a stirrer, then 1 part by weight of boron trifluoride-phenol complex and 7 parts by weight of phenol were added thereto, followed by conducting polymerization at 70° C. for 3 hours. To the resultant reaction mixture solution was added a 2 wt-% sodium hydroxide aqueous solution to remove the catalyst, then, the solution was washed with water. After washing the reaction mixture solution till it became neutral, the organic layer was distilled to remove unreacted materials and a low polymerization product to obtain a petroleum resin A (Tg: 43° C.; Mw=1,450, Mn=730).

Then, 6.0 kg of the petroleum resin A, 4.0 kg of a commercially available polystyrene resin (Tg: 102.0° C.; Mw=340,195; Mn=111,082; position of the maximum value: 280,000) and 0.4 kg of Sazol wax having a melt viscosity at 140° C. of 10 mPa/s(cp) (weight loss measured at 200° C. in a thermal analyzer TGA: 0%) were mixed in a Henschel mixer, then subjected to a bi-axial extruder of 30 mm in screw diameter to obtain a uniform resin composition B.

PRODUCTION EXAMPLE 2

Synthesis of Resin C and Production of Resin Composition D

The atmosphere in the reaction system of a 5-liter separable flask equipped with a cooling tube was replaced with nitrogen, and 1 liter of toluene was poured thereinto. This was heated by means of a mantle heater to realize a toluene-refluxed state. Then, a mixture solution of 850 g of styrene, 150 g of n-butyl acrylate and 2 g of benzoyl peroxide was dropwise added thereto over 3 hours under stirring. After completion of the dropwise addition, stirring was further continued under reflux of toluene for 9 hours, then the cooling tube was removed, and the temperature of the reaction vessel was gradually raised to 180° C. to distill off toluene, followed by treatment under reduced pressure to obtain resin C (Tg: 71° C.; Mw=250,000; Mn=100,000; position of the maximum value: 220,000).

In the same manner as in Production Example 1 except for using resin C in place of the commercially available polystyrene, there was produced a resin composition to obtain a uniform resin composition D.

PRODUCTION EXAMPLE 3

Synthesis of Resin E and Production of Resin Composition F 750 g of styrene, 250 g of n-butyl acrylate and 3 g of benzoyl peroxide was dispersed in water in a 5-liter flask, suspension polymerization was conducted at 85° C. for 5 hours and at 95° C. for 2 hours using calcium phosphate as a stabilizer, followed by dehydrating and drying the product to obtain resin E (Tg: 60° C.; Mw=350,000; Mn=150,000; position of the maximum value: 300,000).

In the same manner as in Production Example 1 except for using resin E in place of the commercially available polystyrene, there was produced a resin composition to obtain a uniform resin composition F.

PRODUCTION EXAMPLE 4

Synthesis of Resin G and Production of Resin Composition H 780 g of styrene, 220 g of 2-ethylhexyl acrylate and 3 g of benzoyl peroxide was charged in a 5-liter flask, bulk polymerization was conducted at 85° C. for 3 hours, then 500 g of xylene and 3 g of benzoyl peroxide were dropwise added thereto over 2 hours while keeping the temperature at 85° C., followed by raising the temperature to 120° C. and keeping at the level for 2 hours to prolong the polymerization, thus resin G (Tg: 58° C.; Mw=350,000; Mn=80,000; position of the maximum value: 200,000) being obtained.

In the same manner as in Production Example 1 except for using resin G in place of the commercially available polystyrene, there was produced a resin composition to obtain a uniform resin composition H.

PRODUCTION EXAMPLE 5

Production of Resin Composition J 700 g of the resin E obtained in Production Example 3, 1,300 g of polystyrene resin I (Tg: 65.0° C.; Mw=5,200; Mn=2,250; position of the maximum value: 4,300), 1,000 g of toluene and 80 g of Sazol wax used in Production Example 1 were placed in a 5-liter flask, mixed under reflux to dissolve or disperse, followed by removing the solvent and drying to obtain resin composition J.

PRODUCTION EXAMPLE 6

Production of Resin Compositions D1 to D4

Resin composition D1, resin composition D2, resin composition D3 and resin composition D4 were produced in the same manner as in the production of resin composition D in Production Example 2 except for changing the amount of the petroleum resin A to 5 kg, 4.5 kg, 7.0 kg and 7.5 kg, respectively, and changing the amount of the resin C to 5 kg, 5.5 kg, 3.0 kg and 2.5 kg, respectively (sum of the petroleum resin A and the resin C in each composition being 10 kg).

PRODUCTION EXAMPLE 7

Production of Resin Compositions F1 to F8

Resin compositions F1 to F8 were obtained in the same manner as in Production Example 3 except for using, in the production of the resin composition F in Production Example 3, Wax A obtained by ester-modifying carnauba wax (weight loss at 200° C. measured in the thermal analyzer TGA: 0%; acid value: 5), Wax B (weight loss at 200° C. measured in the thermal analyzer TGA: −1.6%; acid value: 12), Wax C (weight loss at 200° C. measured in the thermal analyzer TGA: −1.10%; acid value: 19), Wax D obtained by ester-modifying Sazol wax (weight loss at 200° C. measured in the thermal analyzer TGA: −1.81%; acid value: 2), Wax E (weight loss at 200° C. measured in the thermal analyzer TGA: −0.49%; acid value: 7), Wax F (weight loss at 200° C. measured in the thermal analyzer TGA: −0.54%; acid value: 16), a commercially available polypropylene wax, Viscol 550P (weight loss at 200° C. measured in the thermal analyzer TGA: 0%) and a commercially available polypropylene wax, Hiwax NP505 (weight loss at 200° C. measured in the thermal analyzer TGA: −0.05%), respectively, in place of Sazol wax.

In the chromatograms obtained by gel permeation chromatography of the resin compositions obtained in the above Production Examples 1 to 7, ratios of the height of the maximum value $P_L$ based on the petroleum resin, $H_{PL}$, the height of the maximum value $P_H$ based on the aforesaid styrene-based copolymer or the styrene-based homopolymer, $H_{PH}$, and the minimum height between the two maximum values, $H_M$, i.e., $H_{PL}$:$H_M$:$H_{PH}$ are as shown in Table 1.

TABLE 1

| | $H_{PL}$ | $H_M$ | $H_{PH}$ |
|---|---|---|---|
| Resin composition B | 60 | 1 | 30 |
| Resin composition D | 50 | 1 | 25 |
| Resin composition D1 | 25 | 1 | 24 |
| Resin composition D2 | 21 | 1 | 35 |
| Resin composition D3 | 65 | 1 | 27 |
| Resin composition D4 | 73 | 1 | 22 |
| Resin compositions F, F1 to F8 | 41 | 1 | 25 |
| Resin composition H | 50 | 1 | 28 |
| Resin composition J | 7 | 1 | 3.5 |

EXAMPLE 1

50 parts by weight of the resin composition B obtained in Production Example 1, 48 parts by weight of magnetite (horizontal FERE diameter: 0.25 μm; content of FeO: 26.5% by weight), 1 part by weight of Nigrosin-based charge control agent and 1 part by weight of a low molecular weight polyethylene (melt viscosity at 140° C.: 5 mPa/s(cp)) were uniformly mixed, kneaded, pulverized and classified to obtain a positively chargeable toner of 10.5 μm in volume average particle size. The toner showed a good pulverizability. Subsequently, 100 parts by weight of this toner was mixed with 0.3 part by weight of hydrophobic silica having an average particle size of 22 mμ and 0.5 part by weight of tungsten carbide having an average particle size of 1.15 μm to obtain a positively chargeable magnetic developer. 60,000 actual copies were respectively produced to test the toner using a commercially available NP-6035 made by Canon Co., Ltd. under three different conditions of ordinary temperature-ordinary humidity (23° C., 50% RH), high temperature-high humidity (30° C., 85% RH) and low temperature-low humidity (10° C., 20% RH). As a result of the tests, the copied images were in good conditions from the start of copying to the end of copying. Additionally, in the copying under the ordinary temperature-ordinary humidity condition, average image density of the obtained images was 1.40 (OD=0.9), and the amount of consumed toner was 50.1 g/K (K=1000 copies).

EXAMPLES 2 to 4

In the same manner as in Example 1 except for using the resin compositions D, D1 and D3, respectively, in place of the resin composition B used in Example 1 were prepared positively chargeable magnetic developers of Example 2 (using the resin composition D), Example 3 (using the resin composition D1) and Example 4 (using the resin composition D3). Every developer caused no problems upon trial preparation of the toner and preparation of the developer. Subsequently, 60,000 actual copies were respectively produced to test these developers using a commercially available NP-6035 made by Canon Co., Ltd. under three different conditions of ordinary temperature-ordinary humidity (23° C., 50% RH), high temperature-high humidity (30° C., 85% RH) and low temperature-low humidity (10° C., 20% RH) as in Example 1. As a result of the tests, the copied images were in good conditions from the start of copying to the end of copying in any cases. Additionally, in the copying under the ordinary temperature-ordinary humidity condition, average image density of the images obtained in Example 2 was 1.41 (OD=0.9), and the amount of consumed toner was 51.0 g/K, average image density of the images obtained in Example 3 was 1.41 (OD=0.9), and the amount of consumed toner was 50.3 g/K, and average image density of the images obtained in Example 4 was 1.40 (OD=0.9), and the amount of consumed toner was 50.3 g/K.

COMPARATIVE EXAMPLES 1 and 2

In the same manner as in Example 1 except for using the resin compositions D2 and D4, respectively, in place of the resin composition B used in Example 1 were prepared positively chargeable magnetic developers of Comparative Example 1 (using the resin composition D2) and Comparative Example 2 (using the resin composition D4). The developer of Comparative Example 1 caused no problems with respect to pulverizability upon toner, and the toner can be prepared in the same manner as in Example 1 and formed into a developer. However, when 100 copies were actually produced to test the developer using a commercially available NP-6035 made by Canon Co., Ltd. under the condition of low temperature-low humidity (10° C., 20% RH), there resulted a fixing failure. Further, the toner of Comparative Example 2 caused binding upon trial production to a pulverizer so much that it could not be formed into a developer unless ability of pulverizing processing was reduced. In addition, the thus formed developer caused hot offset in actually producing 100 copies using a commercially available copier of NP-6035 made by Canon Co., Ltd. under the condition of low temperature-low humidity (10° C., 20% RH), and failed to produce good copied images. Additionally, in the copying test under the ordinary temperature-ordinary humidity condition, the images produced by the developer of Comparative Example 1 showed an average image density of 1.30 (OD=0.9), and the amount of consumed developer was 52.0 g/K, and the images produced by the developer of Comparative Example 2 showed an average image density of 1.35 (OD=0.9), and the amount of consumed developer was 51.0 g/K.

EXAMPLE 5

50.5 parts by weight of the resin composition D obtained in Production Example 2, 48 parts by weight of magnetite (horizontal FERE diameter: 0.3 μm; content of FeO: 20.5% by weight) and 1.5 parts by weight of an iron-monoazo complex salt charge control agent were uniformly mixed, kneaded, pulverized and classified to obtain a negatively chargeable toner of 8.5 μm in volume average particle size. The toner showed a good pulverizability. 100 parts by weight of this toner was mixed with 0.25 part by weight of hydrophobic silica having an average particle size of 17 mμ and 2 parts by weight of calcium titanate having an average particle size of 0.7 μm to obtain a negatively chargeable magnetic developer. 10,000 actual copies were respectively produced to test the developer using a commercially available copier of IR-2000 made by Canon Co., Ltd. under three different conditions of ordinary temperature-ordinary humidity (23° C., 50% RH), high temperature-high humidity (30° C., 85% RH) and low temperature-low humidity (10° C., 20% RH). As a result of the tests, the copied images were found to be in good conditions from the start of copying to the end of copying in any cases.

EXAMPLES 6 to 8

In the same manner as in Example 5 except for using the resin compositions B, D1 and D3, respectively, in place of the resin composition D used in Example 5 were prepared negatively chargeable developers of Example 6 (using the resin composition B), Example 7 (using the resin composition D1) and Example 8 (using the resin composition D3). Every developer caused no problems upon trial preparation of the toner and preparation of the developer. Subsequently, 10,000 actual copies were respectively produced to test these developers using a commercially available copier of IR-2000 made by Canon Co., Ltd. under three different conditions of ordinary temperature-ordinary humidity (23° C., 50% RH), high temperature-high humidity (30° C., 85% RH) and low temperature-low humidity (10° C., 20% RH) as in Example 5. As a result of the tests, the copied images were found to be in good conditions from the start of copying to the end of copying in any cases.

COMPARATIVE EXAMPLES 3 to 5

In the same manner as in Example 5 except for using the resin compositions D2, D4 and J, respectively, in place of the resin composition D used in Example 5 were prepared negatively chargeable magnetic developers of Comparative Example 3 (using the resin composition D2), Comparative Example 4 (using the resin composition D4) and Comparative Example 5 (using the resin J). The developers of Comparative Examples 3 and 4 caused no problems with respect to pulverizability upon preparation of toner. However, when 200 copies were actually produced to test the both developers using a commercially available copier IR-2000 made by Canon Co., Ltd. under the condition of ordinary temperature-ordinary humidity (23° C., 50% RH), there resulted a fixing failure. Also, the toner of Comparative Example 5 caused serious deposition upon trial production in a pulverizer so much that the toner could not be prepared unless the amount of the toner to be charged into the pulverizer was considerably decreased as in Comparative Example 2. In addition, when actual copying was conducted using a commercially available copier of IR-2000 made by Canon Co., Ltd., there arose the offset phenomenon after producing 30 copies under the condition of ordinary temperature-ordinary humidity (23° C., 50% RH).

EXAMPLE 9

86 parts by weight of the resin composition D obtained in Production Example 2, 10 parts by weight of carbon (primary particle size: 21 mμ; BET specific surface area: 115 $m^2/g$), 2 parts by weight of a chromium-containing monoazo complex salt charge control agent and 2 parts by weight of polypropylene wax were uniformly mixed, kneaded, pulverized and classified to obtain a negatively chargeable toner of 10.0 μm in volume average particle size. The toner did not cause the phenomenon of depositing within the pulverizer upon trial preparation of the toner. Then, a developer containing 3.0% by weight of the toner was prepared using a magnetite carrier having a volume average particle size of 80 μm and the above-described negatively chargeable toner, and 350,000 copies under the conditions of ordinary temperature-ordinary humidity (23° C., 50% RH), 100,000 copies under the conditions of high temperature-high humidity (30° C., 85% RH) and 100,000 copies under the conditions of low temperature-low humidity (10° C., 20% RH) were produced using a copier 5265 made by Lanier Co. As a result of the tests, the copied images were found to be in good conditions from the start of copying to the end of copying.

EXAMPLES 10 and 11

In the same manner as in Example 9 except for using the resin compositions B and H, respectively, in place of the resin composition D used in Example 9 were prepared negatively chargeable developers of Example 10 (using the resin composition B) and Example 11 (using the resin composition H). Every developer did not cause the phenomenon of depositing within the pulverizer upon trial preparation of the toner. Then, developers each containing 3.0% by weight of the individual toner were prepared using a magnetite carrier having a volume average particle size of 80 μm and the above-described negatively chargeable toners, and 350,000 copies under the conditions of ordinary temperature-ordinary humidity (23° C., 50% RH), 100,000 copies under the conditions of high temperature-high humidity (30° C., 85% RH) and 100,000 copies under the conditions of low temperature-low humidity (10° C., 20% RH) were produced respectively using a copier 5265 made by Lanier Co. As a result of the tests, the copied images were found to be in good conditions from the start of copying to the end of copying.

COMPARATIVE EXAMPLES 6 and 7

In the same manner as in Example 9 except for using the resin compositions J and D2, respectively, in place of the resin composition D used in Example 9 were prepared negatively chargeable magnetic developers of Comparative Example 6 (using the resin composition J) and Comparative Example 7 (using the resin composition D2). Every developer did not cause the phenomenon of deposition within the pulverizer upon trial preparation of the toner. Then, developers each containing 3.0% by weight of the individual toner were prepared using a magnetite carrier having a volume average particle size of 80 μm and the above-described negatively chargeable toners. When 1,000 copies were actually produced using a copier 5265 made by Lanier Co. under the condition of low temperature-low humidity (10° C., 20% RH), the both developers gave images with a fixing failure.

EXAMPLE 12

88 parts by weight of the resin composition F obtained in Production Example 3, 10 parts by weight of carbon (primary particle size: 21 mμ; BET specific surface area: 115 $m^2/g$) and 2 parts by weight of a chromium-containing monoazo complex salt charge control agent were uniformly mixed, kneaded, pulverized and classified to obtain a negatively chargeable toner of 10.0 μm in volume average particle size. Then, a developer containing 3.0% by weight of the toner was prepared using a magnetite carrier having a volume average particle size of 80 μm and the above-described negatively chargeable toner. 1,000 copies were produced under the condition of low temperature-low humidity (10° C., 20% RH) by a copier 5265 made by Lanier Co. using this developer and the toner to conduct a fixing test and a smell test. Results thus obtained are shown in Table 2.

Additionally, fixability and smell were evaluated by the following methods.

(Fixability)

Fixability was evaluated as follows. 1.5 cm×1.5 cm patches respectively having original densities of 0.7, 0.9, 1.1 and 1.3 were printed and, after copying them, image densities of the respective copies were measured in terms of reflection density with a reflection densitometer. Then, the copied images were lifted off using a mending tape 810 made by 3M Co., followed by measuring the reflection density of each of the remaining copies. Image retention ratio (remaining image density/copied image density×100) was taken as the fixing strength. Developer samples with a retention ratio of 80% or more were evaluated as having good fixability (O), whereas those with less than 80% as causing fixing failure (X).

(Smell Test)

It was detected through the five senses whether smell was generated or not upon completion of the actually copying test, and developers not generating a smell from the copier was evaluated as good (O), and developers generating a small as bad (X).

EXAMPLES 13 to 18 AND COMPARATIVE EXAMPLES 8 to 10

In the same manner as in Example 12 except for using the resin compositions F1 to F8 and J, respectively, in place of the resin composition F used in Example 12 were prepared developers of Example 13 (using the resin composition F1), Example 14 (using the resin composition F2), Example 15 (using the resin composition F3), Example 16 (using the resin composition F4), Example 17 (using the resin composition F5), Example 18 (using the resin composition F6), Comparative Example 8 (using the resin composition F7), Comparative Example 9 (using the resin composition F8) and Comparative Example 10 (using the resin composition J). Then, 1,000 copies were produced under the condition of low temperature-low humidity (10° C., 20% RH) as in Example 12 by a copier of 5265 made by Lanier Co. using the developers and the toners to conduct a fixing test and a smell test for evaluating fixability and smell. Results thus obtained are shown in Tables 2 and 3.

TABLE 2

| Example No. | 12 | 13 | 14 | 15 | 16 | 17 | 18 |
|---|---|---|---|---|---|---|---|
| Composition | F | F1 | F2 | F3 | F4 | F5 | F6 |
| Wax | Sazol wax | Wax A | Wax B | Wax C | Wax D | Wax E | Wax F |
| Melt viscosity at 140° C. (mPa/s) | 10 | 5 | 5 | 5 | 5 | 7 | 5 |
| Smell | ○ | ○ | X | ○ | X | ○ | ○ |
| Weight loss at 200° C. (wt-%) | 0.00 | 0.00 | −1.61 | −1.10 | −1.81 | −0.49 | −0.54 |
| Fixability | ○ | ○ | ○ | ○ | ○ | ○ | ○ |
| Offset resistance | ○ | ○ | ○ | ○ | ○ | ○ | ○ |

TABLE 3

| Comparative Example No. | 8 | 9 | 10 |
|---|---|---|---|
| Composition | F7 | F8 | J |
| Wax | Viscol 550P | Hiwax NP505 | Sazol wax |
| Melt viscosity at 140° C. (mPa/s) | Impossible to measure | Impossible to measure | 10 |
| Smell | ○ | ○ | ○ |
| Weight loss at 200° C. (wt-%) | 0.00 | −0.05 | 0.00 |
| Fixability | X | X | X |
| Offset resistance | X | X | ○ |

As is apparent from Tables 2 and 3, when a wax having a melt viscosity at 140° C. of 100 mPa/s(cp) or less is used in a series of the resin compositions F type, there are involved no problems and, further, that, with toners showing a weight loss of 1.5% or less at 200° C. in the presence of the air measured by TGA, there is involved no problem of generating offensive smell due to the wax after formed into the toner.

As described above, the electrostatic image developing toner of the invention shows an excellent fixability at lower temperatures, excellent anti-offset properties, and excellent anti-blocking properties, and can be preferably used for developing an electrostatic latent image formed by the electrophotography, electrostatic recording method, electrostatic printing method, or the like.

Further, the invention enables to obtain a fixed toner having a high reflection density without giving an offensive smell upon fixation, and enables to obtain a copied or recorded product with a desired density using a smaller amount of the toner, thus being suited as a developer for resource-saving copiers.

Still further, the invention provides a toner showing excellent toner-pulverizing properties.

While the invention has been described in detail and with reference to specific examples thereof, it will be apparent to one skilled in the art that various changes and modifications can be made therein without departing from the spirit and scope thereof.

What is claimed is:

1. An electrostatic image developing toner comprising at least a binder resin and a releasant, wherein the binder resin comprises a petroleum resin and a styrene-based copolymer or styrene-based homopolymer in an amount of 5:5 to 7:3 by weight in terms of the ratio of the petroleum resin:styrene-based copolymer or styrene-based homopolymer and has the maximum molecular weight value ($P_L$) based on the petroleum resin in a range of from $5\times10^2$ to $2\times10^3$ and the maximum molecular weight value ($P_H$) based on the styrene-based copolymer or styrene-based homopolymer in a range of from $1\times10^5$ to $4.5\times10^5$ in the chromatogram obtained by measuring the binder resin through gel permeation chromatography, $H_{PL}:H_M:H_{PH}$=25 to 65:1:20 to 40, in which $H_{PL}$ represents the height of the maximum molecular weight value $P_L$ based on the petroleum resin in the chromatogram obtained by measuring the binder resin through gel permeation chromatography, $H_{PH}$ represents the height of the maximum molecular weight value $P_H$ based on the styrene-based copolymer or the styrene-based homopolymer in the chromatogram obtained by measuring the binder resin through gel permeation chromatography, and $H_M$ represents the minimum height between the two maximum values, and the releasant is a wax having a melt viscosity at 140° C. of $10^2$ mPa/s (cp) or less and is added in an amount of 1 to 7 parts by weight per 100 parts by weight of the toner.

2. The electrostatic image developing toner according to claim 1, wherein the petroleum resin has a glass transition point Tg of 35 to 55° C. and the styrene-based copolymer has a glass transition point Tg of 50 to 75° C.

3. The electrostatic image developing toner according to claim 1, wherein a weight loss of the wax when subjected to measurement in a thermal analysis apparatus TGA at 200° C. is less than 1.5%.

4. The electrostatic image developing toner according to claim 1, wherein magnetite having a horizontal FERE diameter of 0.1 to 0.5 $\mu$m and containing 18 to 28% by weight of FeO is contained in an amount of 35 to 55 parts by weight per 100 parts by weight of the toner.

5. The electrostatic image developing toner according to claim 1, wherein a dye or pigment is contained as a colorant in an amount of 1 to 12 parts by weight per 100 parts by weight of the toner.

6. An image-forming method comprising steps of: forming an electrostatic image on an electrostatic latent image carrier; forming an toner image by developing the electrostatic latent image using the electrostatic image developing toner described in any one of claim 1, 2, 3, 4 or 5; transferring the toner image on a transfer member; and fixing by heating the toner image transferred onto the transfer member.

* * * * *